US010272443B2

(12) United States Patent
Ivanoff

(10) Patent No.: US 10,272,443 B2
(45) Date of Patent: Apr. 30, 2019

(54) APPARATUS FOR WASHING AND GRADING SAND AND AGGREGATE

(71) Applicant: CDE Global Limited, Cookstown, County Tyrone (GB)

(72) Inventor: Enda Ivanoff, County Tyrone (GB)

(73) Assignee: CDE Global Limited, Cookstown, County Tyrone (GB)

( * ) Notice: Subject to any disclaimer, the term of this patent is extended or adjusted under 35 U.S.C. 154(b) by 0 days.

(21) Appl. No.: 15/918,640

(22) Filed: Mar. 12, 2018

(65) Prior Publication Data

US 2018/0257087 A1 Sep. 13, 2018

(30) Foreign Application Priority Data

Mar. 13, 2017 (GB) ..... 1703950.4

(51) Int. Cl.
*B03B 5/04* (2006.01)
*B03B 5/34* (2006.01)
(Continued)

(52) U.S. Cl.
CPC ..... *B03B 9/00* (2013.01); *B03B 5/04* (2013.01); *B03B 5/34* (2013.01); *B03B 11/00* (2013.01);
(Continued)

(58) Field of Classification Search
CPC .... B03B 9/00; B03B 5/04; B03B 5/34; B03B 11/00
(Continued)

(56) References Cited

U.S. PATENT DOCUMENTS 4,128,474 A * 12/1978 Ennis ..... B03B 5/626 209/13
8,807,343 B2 * 8/2014 Bailey ..... B07B 1/28 209/12.1
(Continued)

FOREIGN PATENT DOCUMENTS

DE 19600897 4/1997
EP 3006112 4/2016
(Continued)

OTHER PUBLICATIONS

UK Search Report dated Sep. 7, 2017 for corresponding UK Application No. GB1703950.4.
(Continued)

*Primary Examiner* — Terrell H Matthews
(74) *Attorney, Agent, or Firm* — Gardner, Linn, Burkhart & Ondersma LLP

(57) ABSTRACT

An apparatus for washing and grading sand and aggregate includes an aggregate grading and washing screen with a plurality of vertically stacked decks for producing a plurality of aggregate products therefrom, and at least one sump for collecting undersize material comprising sand and water from the plurality of decks. A plurality of sand washing and grading units each include a first hydrocyclone, a vibratory screen having a deck, and a sump beneath the deck for receiving undersize material and water passing through the deck. The deck of the vibratory screen receives an underflow from the first hydrocyclone. A further hydrocyclone receives undersize material and water from the vibratory screen's sump. Underflow from the further hydrocyclone is delivered onto the deck of the vibratory screen. The first hydrocyclone of each sand washing and grading unit receives undersize material and water from the sump of the aggregate washing and grading screen.

12 Claims, 1 Drawing Sheet

(51) Int. Cl.
*B03B 9/00* (2006.01)
*B07B 15/00* (2006.01)
*B03B 11/00* (2006.01)

(52) U.S. Cl.
CPC ..... *B07B 15/00* (2013.01); *B07B 2201/04* (2013.01); *B07B 2230/01* (2013.01)

(58) Field of Classification Search
USPC ..... 209/12.1, 13, 16–18
See application file for complete search history.

(56) References Cited

U.S. PATENT DOCUMENTS

| | | | | |
|---|---|---|---|---|
| 9,079,222 | B2 | 7/2015 | Burnett et al. | |
| 9,643,115 | B2 | 5/2017 | Convery | |
| 9,744,537 | B2 | 8/2017 | Convery et al. | |
| 9,776,214 | B2 * | 10/2017 | Vallelly | B07B 1/005 |
| 2004/0055972 | A1 | 3/2004 | Gamer et al. | |
| 2017/0291198 | A1 * | 10/2017 | Vallelly | B03B 5/00 |

FOREIGN PATENT DOCUMENTS

| | | | | |
|---|---|---|---|---|
| GB | 2074050 | | 10/1981 | |
| GB | 2505483 | A * | 3/2014 | B07B 1/28 |
| GB | 2505483 | | 5/2014 | |
| GB | 2523658 | | 2/2015 | |
| GB | 2523658 | A * | 9/2015 | B07B 1/005 |
| GB | 2528257 | | 1/2016 | |
| GB | 2546491 | | 7/2017 | |
| RO | 112255 | | 7/1997 | |
| WO | 9741194 | | 11/1997 | |

OTHER PUBLICATIONS

European Search Report dated Aug. 20, 2018 for corresponding UK Application No. GB1703950.4.

* cited by examiner

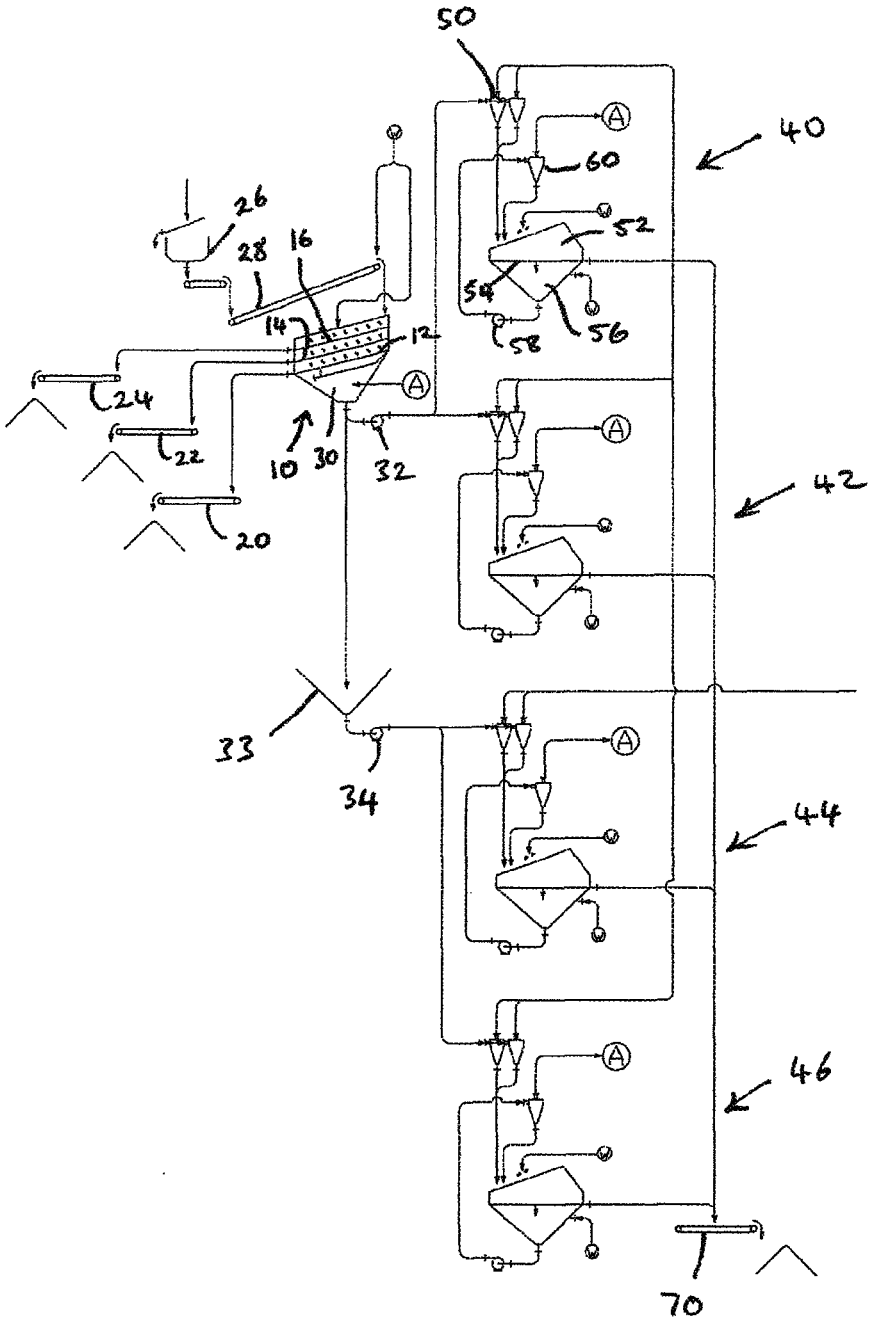
50
40
60
52
54
56
58
26
28
16
14
12
24
22
20
10
30
32
42
33
34
44
46
70

APPARATUS FOR WASHING AND GRADING SAND AND AGGREGATE

FIELD OF THE INVENTION

This invention relates to an apparatus for washing and grading sand and aggregate, and in particular to an apparatus for washing and grading sand and aggregate with high throughput yet low turbidity/low fines content in sand products.

BACKGROUND OF THE INVENTION

The term "aggregates" is generally used to describe a broad category of coarse particulate material used in construction, including sand, gravel and crushed stone. Aggregates are the most mined materials in the world. Aggregates are typically washed and graded on a combination of vibrating screens and hydrocyclones to produce washed aggregate products having a predetermined grain size or range of grain size. The term "aggregate" is more typically used to describe particulate material having a grain size of over 6 mm while the term "sand" is typically used to describe particulate having a grain sand of between 0.075 mm and 6 mm and such terminology will be used to describe such particulate material hereinafter.

A typical vibrating screen comprises a frame, defined by a pair of substantially parallel side walls interconnected by transversely extending bridging members, upon which is mounted one or more polyurethane decks having small openings or slots for water and undersize particles to pass through. The frame is typically mounted on a base via resilient linkages and the frame, and thus the deck or decks are typically vibrated by means of a pair of counter rotating rotors defining eccentric masses, driven by one or more drive motors, to impart circular or reciprocating vibrating motion to the deck(s). Such screens can be used for grading and/or dewatering particulate material, oversize material passing over the deck(s) of the screen to be collected from a downstream end of the screen while water and undersize material is collected in a sump of the screen for subsequent processing.

A hydrocyclone is a device used to separate particles in a liquid suspension based on the ratio of their centripetal force to fluid resistance. This ratio is high for coarse particles and low for fine particles. A hydrocyclone typically comprises a cylindrical section having an inlet for supplying a feed slurry into the hydrocyclone tangentially, and a conical base. Outlets are provided at upper and lower ends of the hydrocyclone. Underflow, containing the coarser fraction, passes out of the lower outlet while overflow, containing the finer fraction and most of the water, passes out of the outlet at the upper end of the hydrocyclone. Thus, as well as removing fine contaminants, a hydrocyclone also serves to reduce the water content of a sand/water slurry.

Hydrocyclones are often used in combination with vibratory screens for washing and dewatering sand, a slurry of sand and water being cleaned and dewatered in one or more hydrocyclones before the sand, contained in the underflow from the hydrocyclones, is delivered onto a deck of a vibratory screen for grading and/or further dewatering.

Most sand and aggregate washing and grading plants are very large, including different stages comprising multiple grading and dewatering screens and hydrocyclones, and typically require a large volume of water to fluidise the material in each stage of the process and to transfer the material between different stages of the process. For washing and grading plants designed to produce one or more grades of aggregate and one or more grades of sand, the throughput of the plant (in terms of tonnes of material processed per hour) is typically limited by the sand washing and grading part of the plant, typically due to limitations imposed by the pumps, hydrocyclones and screens used to wash and grade the sand. Furthermore, when adapted for high throughput (typically requiring a high volume of water), the sand washing and grading process tends to operate with a high turbidity due to difficulties in removing fines at high sand flow rates.

SUMMARY OF THE INVENTION

The present invention provides a particularly adaptable apparatus that can produce up to three different grades of washed aggregate and one or more grade of sand with high throughput, low turbidity and low water consumption.

In one aspect of the present invention there is provided an apparatus for washing and grading sand and aggregate comprising an aggregate grading and washing screen having a plurality of vertically stacked decks for producing a plurality of aggregate products therefrom and at least one sump for collecting undersize material comprising sand and water from the plurality of decks; and a plurality of sand washing and grading units; each sand washing and grading unit comprising a first hydrocyclone, a vibratory screen having a deck for producing at least one sand product and a sump beneath the deck for receiving undersize material and water passing through the deck, the deck of the vibratory screen receiving an underflow from the first hydrocyclone; and a further hydrocyclone receiving undersize material and water from the sump of the vibratory screen, an underflow from the further hydrocyclone being delivered onto the deck of the vibratory screen; wherein the first hydrocyclone of each of the plurality of sand washing and grading units is adapted to receive undersize material and water from the at least one sump of the aggregate washing and grading screen.

In one embodiment the aggregate washing and grading screen may comprise a triple deck screen for producing three separate grades of aggregate. In such embodiment the aggregate grading and washing screen may comprise substantially parallel upper, intermediate and lower decks mounted on a frame defined by a pair of substantially parallel side walls interconnected by transversely extending bridging members and incorporating a vibration generating means for imparting vibratory motion to the screen. Each deck of the aggregate washing and grading screen may be inclined downwardly from an upper receiving end to a lower discharge end at which over-sized material (relative to the screen deck concerned) can be discharged. Each of the upper, intermediate and lower screen decks may incorporate a plurality of slots or apertures formed therein for water and/or undersize particles to pass through, wherein the openings or slots in the upper deck are larger than those of the intermediate deck, which are in turn larger than those of the lower deck.

A first stockpile belt conveyor may be arranged to receive oversize material from the discharge end of the lower deck of the aggregate washing and grading screen, a second stockpile conveyor being arranged to receive oversize material from the discharge end of the intermediate deck of the aggregate washing and grading screen, and a third stockpile conveyor being arranged to receive over-sized material from the discharge end of the upper deck of the aggregate washing and grading screen.

The at least one sump of the aggregate washing and grading screen may be associated with at least one pump configured to pump water and undersize material therefrom to a respective inlet of the first hydrocyclone of each sand washing and grading unit.

An overflow from the further hydrocyclone of each sand washing and grading unit, being relatively clean, may be supplied to the aggregate washing and grading screen, thereby reducing the water consumption of the apparatus. In one embodiment the overflow from the further hydrocyclone of each sand washing and grading unit may be supplied to the sump of the aggregate washing and grading screen to control the water content of the material therein. Alternatively, or additionally, the overflow from the further hydrocyclone of each sand washing and grading unit may be supplied to spray bars and/or a wash box of the aggregate washing and grading screen. It is also envisaged that the overflow from the further hydrocyclone of each sand washing and grading unit may be supplied to a settling tank for reuse or disposal.

The first hydrocyclone of at least one of the sand washing and grading units may comprise a plurality of cyclones arranged in parallel with a common overflow manifold and a common underflow manifold. The first hydrocyclone of at least one of the sand washing and grading units may comprise two cyclones arranged in parallel.

The further hydrocyclone of each sand washing and grading unit may be mounted adjacent the first hydrocyclone thereof, above the deck of the vibratory screen thereof.

In one embodiment the oversize material from a downstream end of the deck of each sand washing and grading unit may be collected onto a conveyor to be delivered therefrom as a single sand product. Alternatively the plurality of sand washing and grading units may be adapted to produce two or more different grade of sand product (in terms of particle size).

These and other objects, advantages and features of the invention will become apparent upon review of the following specification in conjunction with the drawings.

BRIEF DESCRIPTION OF THE DRAWING

An apparatus for washing and grading sand and aggregate in accordance with an embodiment of the present invention will now be described, with reference to the accompanying drawings, in which:

FIG. 1 is a schematic view of an apparatus for washing and grading sand and aggregate in accordance with an embodiment of the present invention.

DETAILED DESCRIPTION OF THE PREFERRED EMBODIMENTS

An apparatus for washing and grading sand and aggregate in accordance with an embodiment of the present invention is illustrated in the drawing, comprises a triple deck aggregate washing and grading screen 10 for producing three separate grades of aggregate. The triple deck aggregate screen 10 may be of the type disclosed in GB 2,523,658, incorporated herein by reference, comprising substantially parallel lower 12, intermediate 14 and upper 16 decks mounted on a frame defined by a pair of substantially parallel side walls interconnected by transversely extending bridging members and incorporating a vibration generating means for imparting vibratory motion to the screen 10. Each of the lower, intermediate and upper screen decks 12, 14, 16 may comprise polyurethane mats having a plurality of slots or apertures formed therein for water and/or undersize particles to pass through. The openings or slots in the upper deck are larger than those of the intermediate deck, which are in turn larger than those of the lower deck.

Each deck 12, 14, 16 of the aggregate screen 10 has a downward slope from an upper receiving end to a lower discharge end at which over-sized material (relative to the screen deck concerned) can be discharged. Material of a size in excess of the size of the screening apertures of each deck of the aggregate screen is discharged under gravity action from the lower end of the respective deck onto a respective stockpile conveyor 20, 22, 24, whereas under-sized material able to pass downwardly through the screening apertures of the respective screen deck falls under gravity onto the deck below, where the further screening action takes place, or into one or more sumps in the case of the lower deck.

The feed material may be transferred onto the upper deck 16 of the aggregate screen 10 via a feed hopper 26 and associated feed conveyor 28, optionally via a wash box (not shown).

Each side wall of the aggregate screen 10 may be made up of a laminated assembly of steel plates, optionally as disclosed in GB 2,505,483, incorporated herein by reference.

Spray bars are mounted above the each deck 12, 14, 16 of the aggregate screen for adding water to the material thereon.

A pump 32 (shown schematically in FIG. 1) is associated with the sump 30 beneath the lower deck 12 of the aggregate screen 10 for pumping water and undersize material to a plurality of sand washing and grading units 40, 42, 44, 46 arranged in parallel. More than one pump 32, 34 may be provided, each pump 32, 34 supplying at least two sand washing and grading units, depending upon the capacity of the pumps 32, 34. One or more additional sumps 33 may be provided adapted to receive undersize material and water from the aggregate screen 10 to effectively increase the capacity of the sump 30. The sumps 30, 33 may selectively receive undersize material and water from the aggregate screen independently as required to meet the capacity demands of the system.

Each sand washing and grading unit 40, 42, 44, 46 comprises a respective first set of hydrocyclones 50 mounted above a respective vibratory screen 52 having a deck 54, wherein the underflow from the respective set of hydrocyclones is delivered onto the deck 54. In the embodiment shown, the first set of hydrocyclones 50 of each sand washing and grading unit 40, 42, 44, 46 comprises two separate cyclones arranged in parallel with a common inlet, common overflow manifold and common underflow manifold. However, more or less cyclones may be used depending upon the desired throughput. The first set of hydrocyclones 50 of each sand washing and grading unit washes and dewaters the sand transferred from the sump 30 of the aggregate screen 10, removing a least a proportion of fine contaminants, such as silt and clay, from the sand.

Washed sand and some water passes out of the underflow of each cyclone of the first set of hydrocyclones 50 of each sand washing and grading unit while water and fine contaminants pass out of the overflows thereof.

Undersize material and water passing through the deck 54 of the respective screen 52 of each sand washing and grading unit is collected in a respective sump 56 beneath the deck 54. A pump 58 is associated with the sump 56 of each sand washing and grading unit for pumping the slurry of water and aggregate therefrom into the inlet of a respective further hydrocyclone 60. The underflow from the further hydrocyclone 60 of each sand washing and grading unit 40, 42, 44, 46 is returned to the deck 54 of the respective screen 52 thereof The provision of the further hydrocyclone 60 provides a further cyclone pass of the sand on the deck 54 of each sand washing and grading unit, maximising the removal of unwanted fines, such as silt, from the sand product or products produced by the sand washing and grading unit 40, 42, 44, 46.

The oversize material from the deck 54 of each sand washing and grading unit 40, 42, 44, 46 may be collected onto a common stockpile conveyor 70 as a single washed sand product, as shown in FIG. 1. Alternatively, it is envisaged that two or more sand products may be produced from the decks 54 of the plurality of sand washing and grading units 40, 42, 44, 46 by providing different sized apertures in individual or groups of the plurality of sand washing and grading units 40, 42, 44, 46.

While in the embodiment shown, four sand washing and grading units 40, 42, 44, 46 are provided, it is envisaged that more or less units may be providing depending upon the required throughput of the apparatus and the amount of fine contamination contained in the feed material.

At least a portion of the overflow from the further hydrocyclones 60 of the plurality of sand washing and grading units, being relatively clean, may be returned to the aggregate washing and grading screen 10 for reuse, for example being supplied to the sump 30 of the aggregate grading and washing screen 10 required to maintain a sufficient water content in the material in the sumps, to allow efficient operation of the pumps associated therewith, and/or to the spray bars or wash box thereof. The overflow from the first set of hydrocyclones 50 may be passed to a thickener tank or settling pond, wherein the silt and other fine contaminants may be removed to allow the water to be reused or suitably disposed of.

Each side wall of each of the screens 52 of the plurality of sand washing and grading units 40, 42, 44, 46 may be made up of a laminated assembly of steel plates, optionally as disclosed in GB 2,505,483, incorporated herein by reference.

In use, sand and water from the sump 30 of the multi-deck aggregate screen 10, and/or from a further sump 33, or further reservoir in communication with the sump 30 of the aggregate screen 10, is pumped to each of the plurality of sand washing and grading unit 40, 42, 44, 46 arranged in parallel, into respective first sets of hydrocyclones 50 mounted above the deck of the respective screen 52 of each sand washing and grading unit 40, 42, 44, 46, and the underflow from the respective first set of hydrocyclones 50 is delivered onto the deck 54 of the respective screen 52. Each sand washing and grading unit 40, 42, 44, 46 includes a respective further hydrocyclone 60 receiving material from the sump 56 of the respective screen 52 and an underflow from the respective further hydrocyclone 60 is delivered back onto the deck 54 of the respective sand washing and grading unit 40, 42, 44, 46. The overflow from each further hydrocyclone 60, being relatively clean, is returned to the aggregate screen 10, thus reducing the water consumption of the overall system.

One or more cleaned sand products are delivered from the downstream end of the deck 54 of each sand washing and grading unit 40, 42, 44, 46 onto a suitable conveyor 70 for stockpiling.

By providing several sand washing and grading units arranged in parallel, the overall throughput of the system is increased without reducing the effectiveness of the fines removal from the sand product.

The invention is not limited to the embodiment described herein but can be amended or modified without departing from the scope of the present invention, which is intended to be limited only by the scope of the appended claims as interpreted according to the principles of patent law including the doctrine of equivalents.

The invention claimed is:

1. An apparatus for washing and grading sand and aggregate comprising:

an aggregate grading and washing screen having a plurality of vertically stacked decks for producing a plurality of aggregate products therefrom;

at least one sump for collecting undersize material comprising sand and water from the plurality of decks;

a plurality of sand washing and grading units, each comprising:

a first hydrocyclone comprising a plurality of cyclones arranged in parallel and having a common overflow manifold and a common underflow manifold;

a vibratory screen having a deck for producing at least one sand product, the deck of the vibratory screen receiving an underflow from the first hydrocyclone;

a sump beneath the deck for receiving undersize material and water passing through the deck; and a further hydrocyclone receiving undersize material and water from the sump of the vibratory screen, wherein an underflow from the further hydrocyclone is delivered onto the deck of the vibratory screen;

wherein the first hydrocyclone of each of the plurality of sand washing and grading units is adapted to receive undersize material and water from the at least one sump of the aggregate washing and grading screen.

2. The apparatus of claim 1, wherein the aggregate washing and grading screen comprises a triple deck screen for producing three separate grades of aggregate.

3. The apparatus of claim 2, wherein the aggregate grading and washing screen comprises substantially parallel upper, intermediate and lower decks mounted on a frame defined by a pair of substantially parallel side walls interconnected by transversely extending bridging members and incorporating a vibration generating means for imparting vibratory motion to the screen.

4. The apparatus of claim 3, wherein each deck of the aggregate washing and grading screen is inclined downwardly from an upper receiving end to a lower discharge end at which over-sized material (relative to the screen deck concerned) can be discharged.

5. The apparatus of claim 3, wherein each of the upper, intermediate and lower screen decks incorporates a plurality of slots or apertures formed therein for water and/or undersize particles to pass through, the openings or slots in the upper deck being larger than the openings or slots of the intermediate deck, and the openings or slots in the intermediate deck being turn larger than the openings or slots of the lower deck.

6. The apparatus of claim 3, wherein a first stockpile belt conveyor is arranged to receive oversize material from the discharge end of the lower deck of the aggregate washing and grading screen, a second stockpile conveyor is arranged to receive oversize material from the discharge end of the intermediate deck of the aggregate washing and grading screen, and a third stockpile conveyor is arranged to receive over-sized material from the discharge end of the upper deck of the aggregate washing and grading screen.

7. The apparatus of claim 1, wherein the at least one sump of the aggregate washing and grading screen is associated with at least one pump configured to pump water and undersize material therefrom to a respective inlet of the first hydrocyclone of each sand washing and grading unit.

8. The apparatus of claim 1, wherein an overflow from the further hydrocyclone of each sand washing and grading unit is supplied to the aggregate washing and grading screen.

9. The apparatus of claim 8, wherein the overflow from the further hydrocyclone of each sand washing and grading unit is supplied to the sump, spray bars and/or wash box of the aggregate washing and grading screen.

10. The apparatus of claim 1, wherein the first hydrocyclone of at least one of the sand washing and grading units comprises two cyclones arranged in parallel.

11. The apparatus of claim 1, wherein the further hydrocyclone of each sand washing and grading unit is mounted adjacent the first hydrocyclone thereof, above the deck of the vibratory screen thereof.

12. The apparatus of claim 1, further comprising a conveyor adapted to collect the oversize material from a downstream end of the deck of each sand washing and grading unit and to deliver the oversize material as a single sand product.

* * * * *